US005674130A

United States Patent [19]

Egan

[11] Patent Number: 5,674,130

[45] Date of Patent: Oct. 7, 1997

[54] GOLF BALL DISPENSER

[75] Inventor: Leslie Egan, Co Clare, Ireland

[73] Assignee: Lesco Enterprises Ltd., Shannon, Ireland

[21] Appl. No.: 446,712

[22] PCT Filed: Nov. 30, 1993

[86] PCT No.: PCT/IE93/00057

§ 371 Date: May 30, 1995

§ 102(e) Date: May 30, 1995

[87] PCT Pub. No.: WO94/12247

PCT Pub. Date: Jun. 9, 1994

[30] Foreign Application Priority Data

Nov. 30, 1992 [IE] Ireland ..... 92 2853
Sep. 22, 1993 [IE] Ireland ..... S93 -0704

[51] Int. Cl.[6] ..... A63B 57/00

[52] U.S. Cl. ..... 473/132; 473/134; 473/137

[58] Field of Search ..... 273/179 R, 179 A, 273/179 C, 181 G, 32.5, 201; 473/132, 133, 134, 137

[56] References Cited

U.S. PATENT DOCUMENTS

| | | | |
|---|---|---|---|
| 3,127,177 | 3/1964 | Benkoe | 273/201 |
| 3,901,515 | 8/1975 | Mozel | 273/201 |
| 3,966,213 | 6/1976 | Bradley | 273/201 |
| 4,732,391 | 3/1988 | Karr | 273/201 |
| 4,741,537 | 5/1988 | Adam | 273/201 |
| 5,071,131 | 12/1991 | Turnidge et al. | 273/201 |
| 5,096,200 | 3/1992 | Komori et al. | 273/201 |
| 5,351,964 | 10/1994 | Kruger | 273/201 |
| 5,415,409 | 5/1995 | Hellmann | 273/201 |
| 5,458,339 | 10/1995 | Wildes | 273/201 |

FOREIGN PATENT DOCUMENTS

| | | |
|---|---|---|
| 0 002 921 | 12/1978 | European Pat. Off. . |
| 2 061 737 | 9/1980 | United Kingdom . |
| 85/02126 | 5/1985 | WIPO . |

*Primary Examiner*—William M. Pierce
*Attorney, Agent, or Firm*—Jacobson, Price, Holman & Stern, PLLC

[57] ABSTRACT

A golf ball dispenser (1) has a fixed tee (21) onto which a ball is placed by an arm (24). The arm (24) moves in a vertical direction being below the level of the tee during play. Downward arm movement for placement is damped by a motor (26) to ensure repeatable secure placement. A vibration sensor (30) detects striking of the ball and a controller (27) then initiates the next placement. The dispenser (1) is simple, reliable and easy to use.

12 Claims, 7 Drawing Sheets

GOLF BALL DISPENSER

FIELD OF THE INVENTION

The invention relates to a golf ball dispenser for the placement of golf balls onto a tee in a golf driving range.

BACKGROUND OF THE INVENTION

Such golf bail dispensers are described in British patent specification No. GB-A-2 061 737 (Eberle), U.S. Pat. No. 3,966,213 (Bradley) and European patent specification No. EP-Al-0 002 921 (Loof). In the British specification, a golf ball trough is described which is movable through 90° and it holds golf balls replenished from a hopper. At the end of the trough there is a pivotal head which is urged to a detent position by a small weight. Movement of the head changes gaps at the end of the trough to allow dispensing of a golf ball onto a tee. In the United States specification, a reciprocating tee assembly is described and there is a support platform for the golfer. In the European specification, there is an elevated magazine and a rotatable carrier which is balanced so that a ball deposited in a receptacle on the carrier causes the arm to pivot under the weight of the ball to deliver a ball to a tee. These mechanisms appear to suffer from the disadvantages that they are relatively complex in operation and it appears that they would not be particularly reliable in accurate placement of a ball on a tee over a long period of time. Another disadvantage is that it is necessary for the golfer to actuate the mechanism in order to cause a ball to be placed on the tee.

U.S. Pat. No. 4,741,537 describes a dispensing mechanism in which there is a gravitational feed to a ball dispenser operated by a pedal pressed by the golfer when a ball is desired. A deflector bar, a depression, a stop plate, and a spring-biased rocker arm cause the ball to enter a transit groove on further depression of the pedal by the golfer. The ball then reaches a further depression having an orifice which is blocked by the ball. Resulting positive pressure in an air supply through the orifice is an indication of presence of the ball, causing a tee to move upwardly with the ball to a playing position. In summary, therefore, ball placement is initiated by the golfer, (by depressing the pedal) and tee control is in response to pressure detection. It appears that this arrangement is quite complex as it involves use of many moving parts.

In U.S. Pat. No. 5,071,131 a teeing device is described which is operated by the golfer pressing a pedestal. A cable, pulley and pivot arm assembly operate to cause a receiver move upwardly in a sudden action, propelling a ball into a track. This track communicates with a second track which pivots in a vertical plane, and when in an operative position allows the ball to roll into a seat having a diameter greater than the ball, thus allowing it to drop onto a tee. The second track then pivots upwardly out of the way. Again, this device appears to be quite complex and thus difficult to manufacture and maintain. Further, it appears that the device may not be particularly effective as the ball must drop—albeit a short distance—onto the tee.

In U.S. Pat. 5,096,200 a teeing machine is disclosed which has a complicated mechanism terminating in a ball-carrying arm rotating in a horizontal plane. An infra-red sensor detects if a ball is on the tee, apparently as a check that the machine has operated correctly. U.S. Pat. No. 3,901,515 describes a teeing mechanism in which mircoswitches and motors are used for control of dispensing a ball onto a track and for movement of a tee platform between lower and upper positions. When a ball is struck, the tee platform is balanced so that it tilts to a second position contacting a microswitch which causes a motor to allow the platform to drop. While this mechanism is somewhat simpler than much of the other prior art mechanisms, it does require a quite complex tee support platform device. Further, the arrangement for sensing when a ball has been struck relies on balancing of the platform and correct operation of a microswitch and motor and associated electrical and mechanical components.

SUMMARY OF THE INVENTION

The present invention is directed towards providing an improved golf ball dispenser which is of relatively simple construction. A further object is that the dispenser be reliable in operation over a long period of time. Another object is that the dispenser be versatile and that it may be used as a portable, stand-alone unit or alternatively as part of an integrated system. A still further object of the invention is that the dispenser be more convenient for use by the golfer.

According to the invention, there is provided a golf ball dispenser for a driving range tee comprising:

a ball storage container;

a placement means for reception of a ball from the storage container and bringing the ball to a rest position adjacent to the end of the placement means; and a controller comprising means for directing relative movement of the placement means and the tee allowing the ball no be placed on the tee and separating the placement means and the ball to expose the ball for use; characterised in that, the placement means comprises an arm which is movable in a substantially vertical direction to place a ball on the tee during a downward movement.

By placing the ball in this simple downward action, the dispenser may have a simple design and performs reliably.

In one embodiment, the dispenser further comprises a detector connected to the controller for detecting presence of a ball on the tee, and the controller further comprises a means for automatically directing placement of a fresh ball on the tee after a ball has been struck off the tee as sensed by the detector. This allows automatic placement so that the next ball may be placed while the player prepares for the next shot.

The detector may be a vibration sensor mounted to detect vibration of the tee. This is a particularly reliable arrangement in which false trigger signals are unlikely. The vibration sensor may be mounted on a support plate for the tee.

The controller preferably comprises a pulse timer connected to the vibration sensor. This is an effective way of discriminating output signals.

The detector may alternatively be a radiation sensor such as an optical sensor. Such sensors are widely available and inexpensive. in another embodiment, the controller comprises means for directing movement of the arm to a lower inoperative position beneath the level of a golf mat after placement, a ball placement cycle involving upward arm movement, receiving a ball, followed by said downward movement to the inoperative position. This arrangement is very simple as there is a simple up-down cycle of arm movement.

The arm may be actuated by a motor, which may comprise a current limiter component for damping downward movement of the arm. This helps to ensure reliable placement.

In another embodiment, the storage container comprises a storage chute, the arm being movable into registry with the chute for reception of the ball under control of a main barrier. The main barrier may be mounted on the arm and move with it. In a further embodiment, the dispenser comprises an auxiliary barrier mounted to prevent delivery of more than one ball at one time to the arm from the storage chute wherein the auxiliary barrier is mounted on the arm and moves with it. These are extremely simple arrangements.

According to another aspect, the invention provides a golf ball dispenser comprising:

a ball storage container;

a placement means for receiving a ball from the storage container and placing the ball on a fixed tee; and a controller for directing operation of the placement means; characterised in that, the dispenser further comprises a golf ball detector connected to the controller for detecting presence of a ball on the fixed tee, and the controller further comprises a means for automatically directing placement of a fresh ball on the fixed tee when a ball has been struck off the tee.

Because the detector is provided to detect a ball on a fixed tee, it may be quite simple and may easily operate reliably. If the tee were movable, the movement and different positions, possibly causing vibrations, could cause false signals to be outputted.

In one embodiment, the detector may comprise a vibration sensor mounted on a support for the tee. In one embodiment, the vibration sensor is connected to a pulse timer circuit in the controller, the controller comprising means for directing placement upon detection of a pre-set number of pulses.

Preferably, the placement means comprises an arm which is movable in a substantially vertical direction to place a ball on the tee during a downward movement.

BRIEF DESCRIPTION OF THE DRAWINGS

The invention will be more clearly understood from the following description of some embodiments thereof given by way of example only with reference to the accompanying drawings in which.

DETAILED DESCRIPTION OF THE PREFERRED EMBODIMENTS

Figure 1:
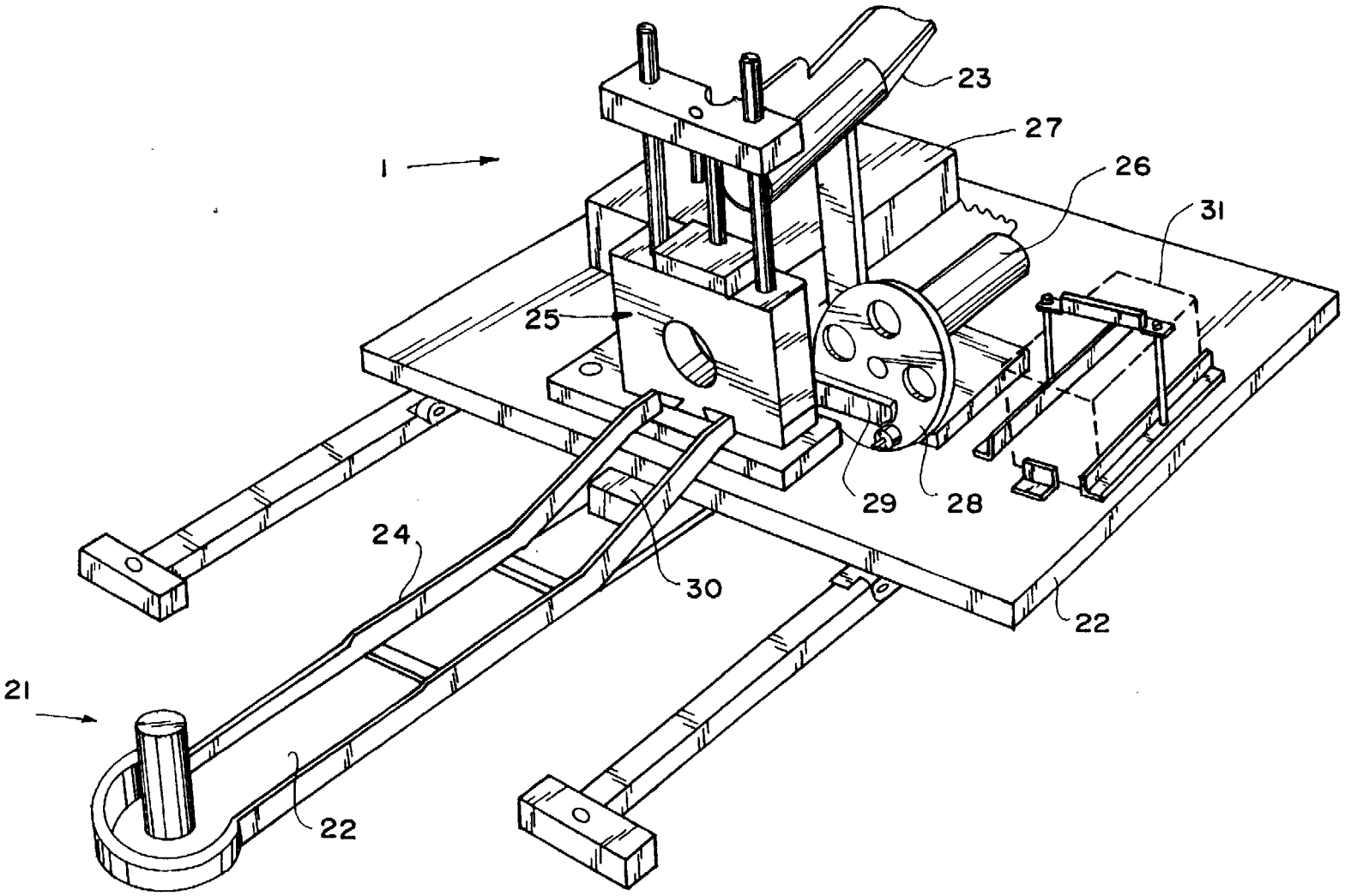
FIG. 1 is a perspective view from above showing a golf ball dispenser of the invention without its container.

Referring to the drawings, there is shown a golf ball dispenser of the invention, indicated generally by the reference 1. The dispenser 1 includes a ball storage container 20 which has an upper portion 2 having a ball rollway 3 for delivering golf balls under gravity feed into a lower portion 4 having an outlet 5. The lower portion 4 houses the dispenser's mechanism.

The dispenser 1 also comprises a golf tee 21 mounted on a base plate 22 of the dispenser. For reception of balls from the storage container 20, there is a storage chute 23 from which a golf ball is delivered onto an arm 24 which is movable in the vertical direction on a support 25. The end of the arm 24 forms a curved seat for a golf ball and surrounds the golf tee 21 when the arm 24 is in a lower, inoperative position. Movement of the arm 24 in the vertical direction is caused by a motor 26 controlled by to a controller 27. The motor 26 drives a flywheel 28 which drives a connecting rod 29, which in turn moves the support 25 in the vertical direction.

Figure 5:
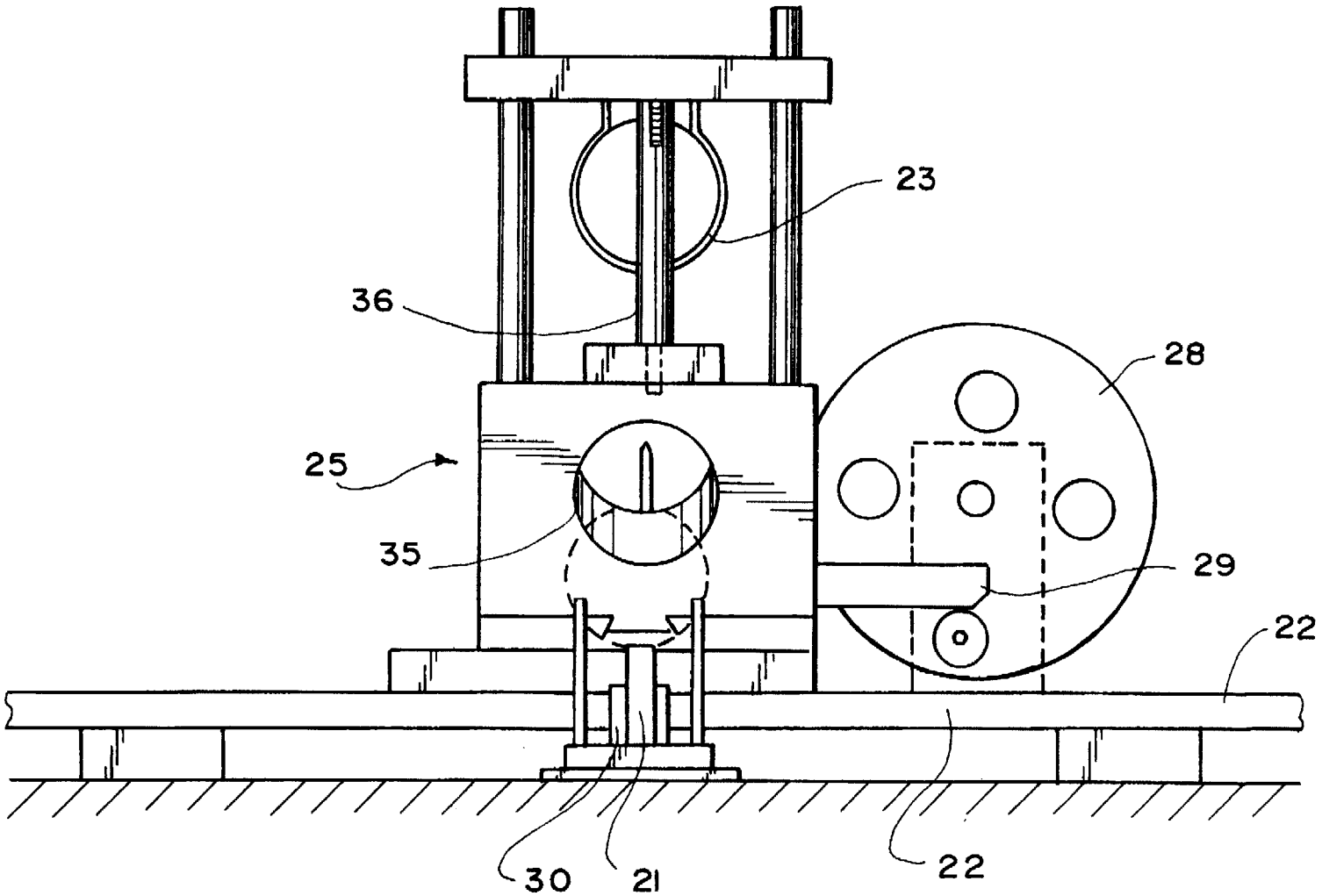

Power for the motor 26 and for the controller 27 may be provided by a battery 31 shown by interrupted lines in FIG. 1, or alternatively by a mains supply. As shown most clearly in FIGS. 4 to 7 inclusive, the support 25 has an aperture 35 which is movable into registry with the end of the storage chute 23 when the support 25 is in an upper position. A main barrier for the chute 23 comprises a rod 36 which is shown most clearly in FIG. 5. This prevents discharge of balls from the chute 23 onto the arm 24 when the support 25 is in the lower, inoperative position. An auxiliary barrier 37 is also mounted on the support 25, the function of which is to prevent more than one ball from being delivered onto the arm 24 an any one time.

An important part of the dispenser 1 is a vibration sensor 30 which is mounted on the plate 22 for detection of vibration of the golf tee 21 caused by hitting a golf ball. The sensor 30 is of the type for detecting vibration of a door or window in an alarm system.

Figure 8:
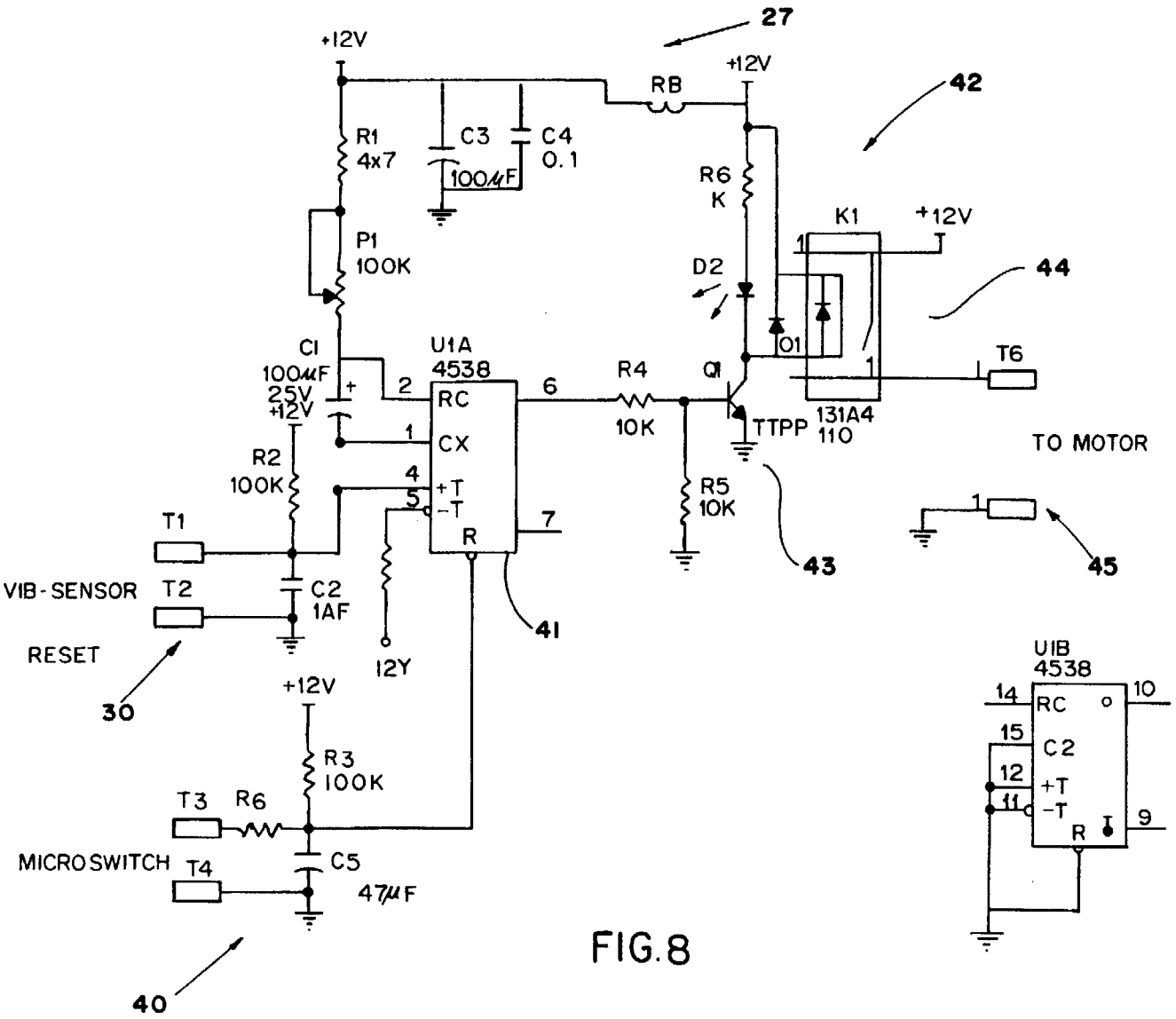
FIG. 8 is a circuit diagram of a controller of the dispenser.

Referring now to FIG. 8, a circuit diagram is shown for the controller 27 and for various electrical parts which it is connected. Parts similar to those described with reference to the previous drawings are identified by the same reference numerals. There is a microswitch 40 which is mounted for detection of movement of the support 25 to its upper position. A 100 KOhm resistor R6 is provided to ensure that the microswitch does not "burn out" by heat generation. The controller 27 comprises a pulse timer 41 which receives inputs from the vibration sensor 30 and the microswitch 40. A 12V supply to the -T pin allows the sensor 30 to operate in the closed position. The output at pin 6 of the pulse timer 41 is connected to a switch circuit 42 having a transistor 43 connected to a relay 44. Output terminals 45 of the swatch circuit 42 are connected to the motor 26. A 47 micro Farad delay capacitor is connected to the microswitch contact T4 to ensure that spurious signals are not transmitted to the timer 41 to indicate prematurely that a ball is required.

Figure 3:
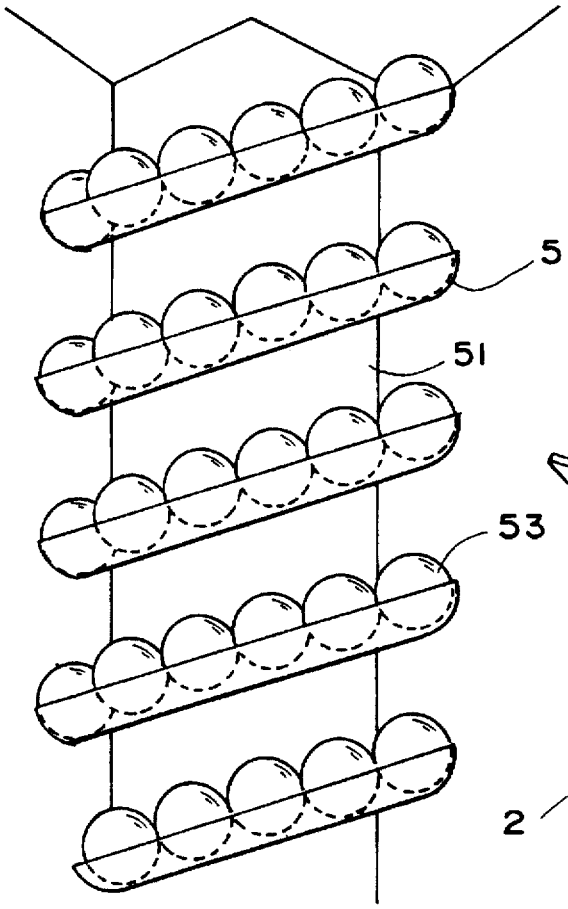
FIG. 3 is a diagrammatic view showing an alternative construction of ball storage container.

Instead of the ball storage container 20, the dispenser of the invention may have a spiral storage container such as that indicated by the numeral 50 in FIG. 3. The container 50 comprises a cylindrical support 51, around which a chute 52 is mounted in a spiral arrangement. Golf balls 53 are shown rolling in the chute 52 under gravity feed.

Figure 2:
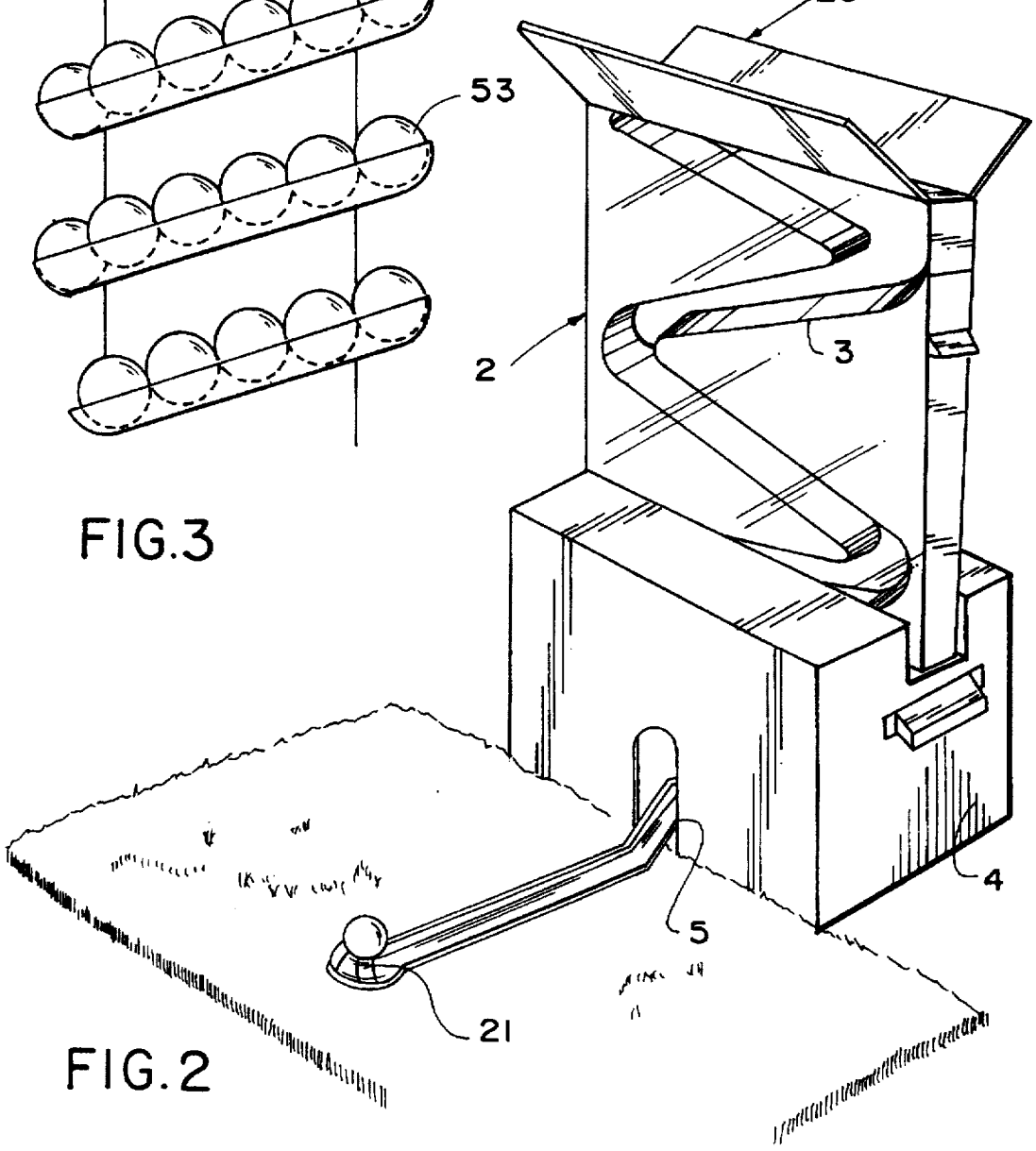
FIG. 2 is a perspective view showing the dispenser with its container.
Figure 4:
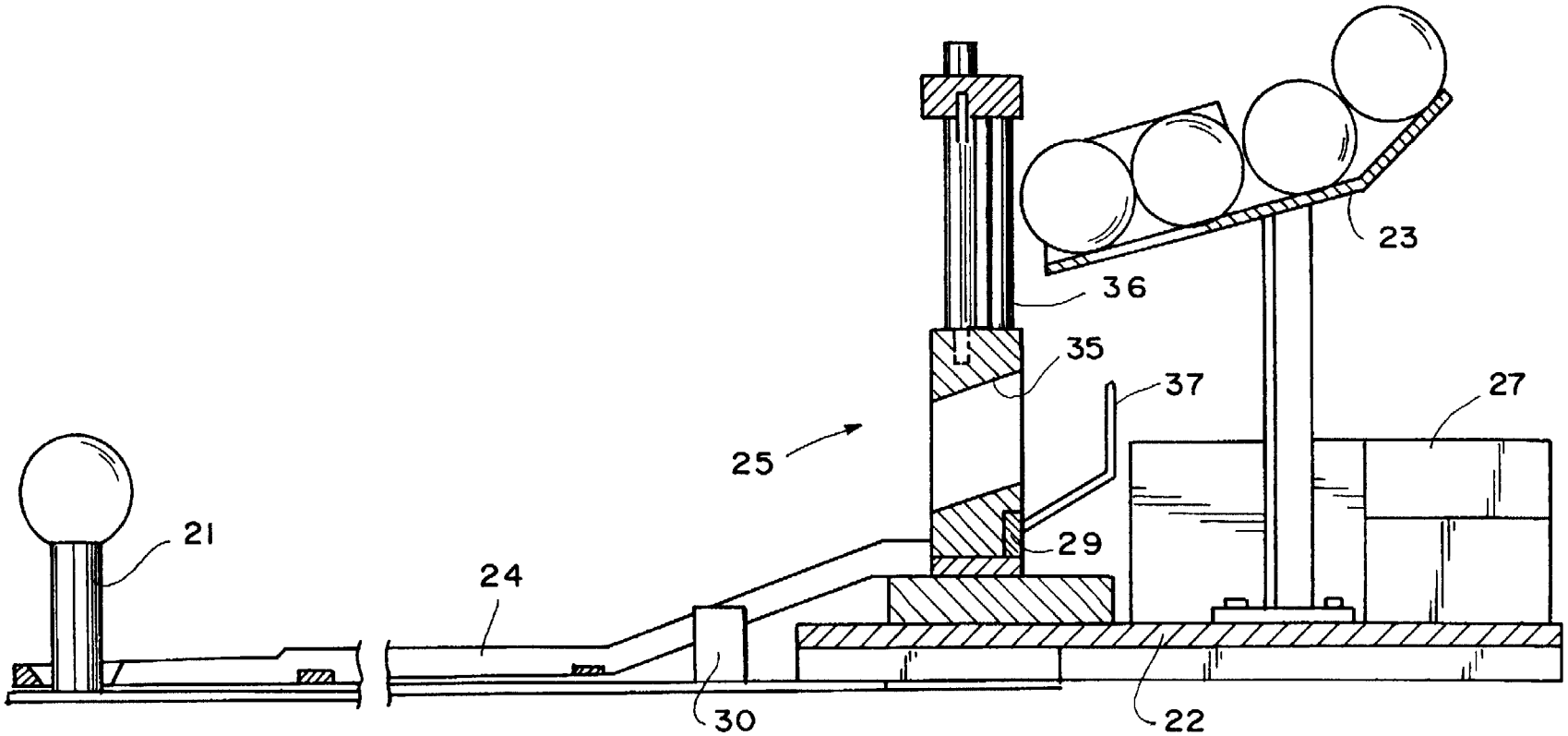
FIGS. 4 and 5 are side and front views respectively showing the dispenser in an inoperative position.

In operation, the dispenser 1 is mounted in a driving range bay in an arrangement whereby the arm 24 is recessed below the level of the golf mat when in the inoperative position, as shown in FIG. 2. The dispenser 1 is, of course, mounted on the opposite side of the tee 21 from where the golfer is to stand. The dispenser may operate on a stand-alone basis, or it may be integrated into a larger system in which case the quantity of balls dispensed may be centrally controlled.

Figure 6:
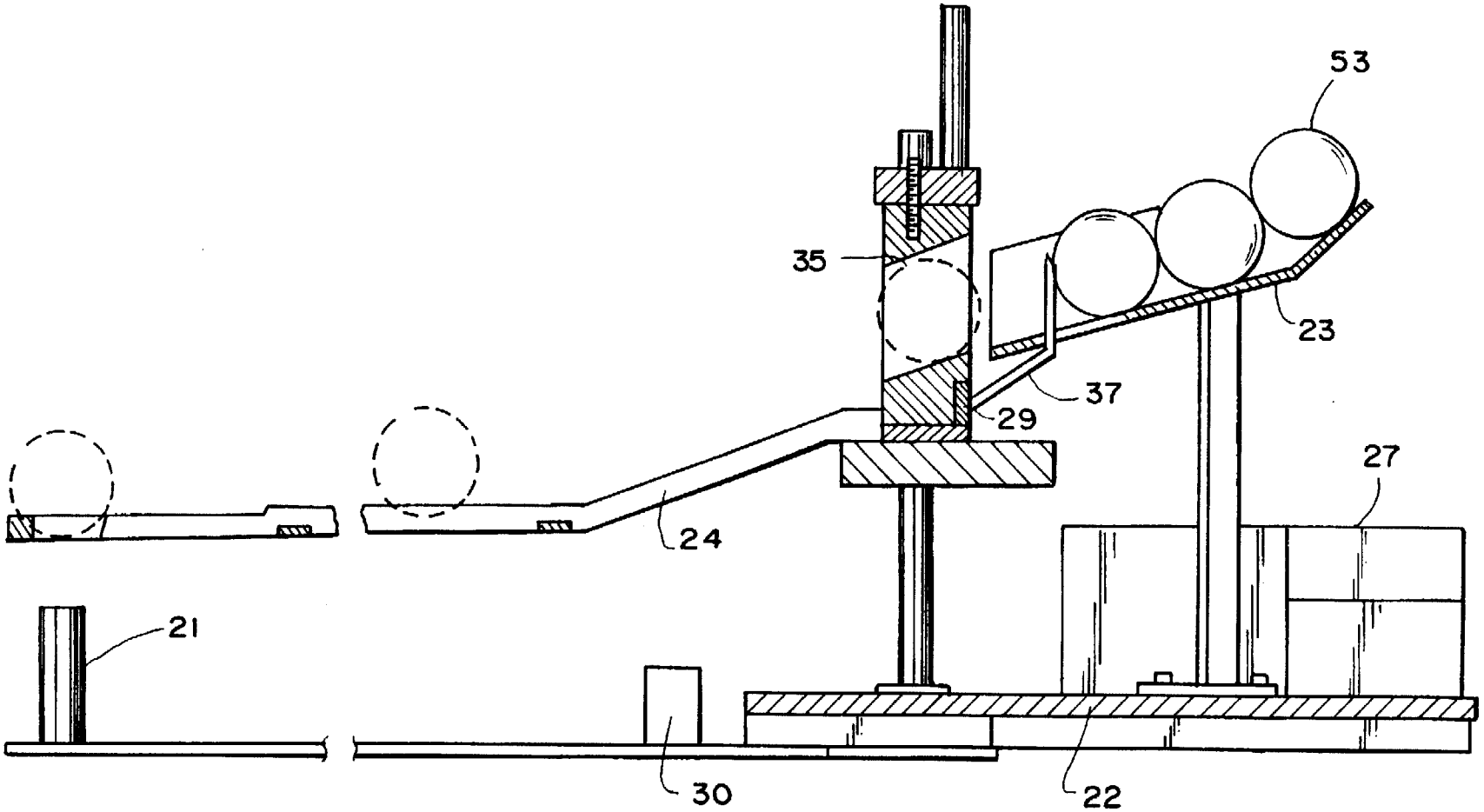
FIGS. 6 and 7 are side and front views respectively showing the dispenser during operation.
Figure 7:
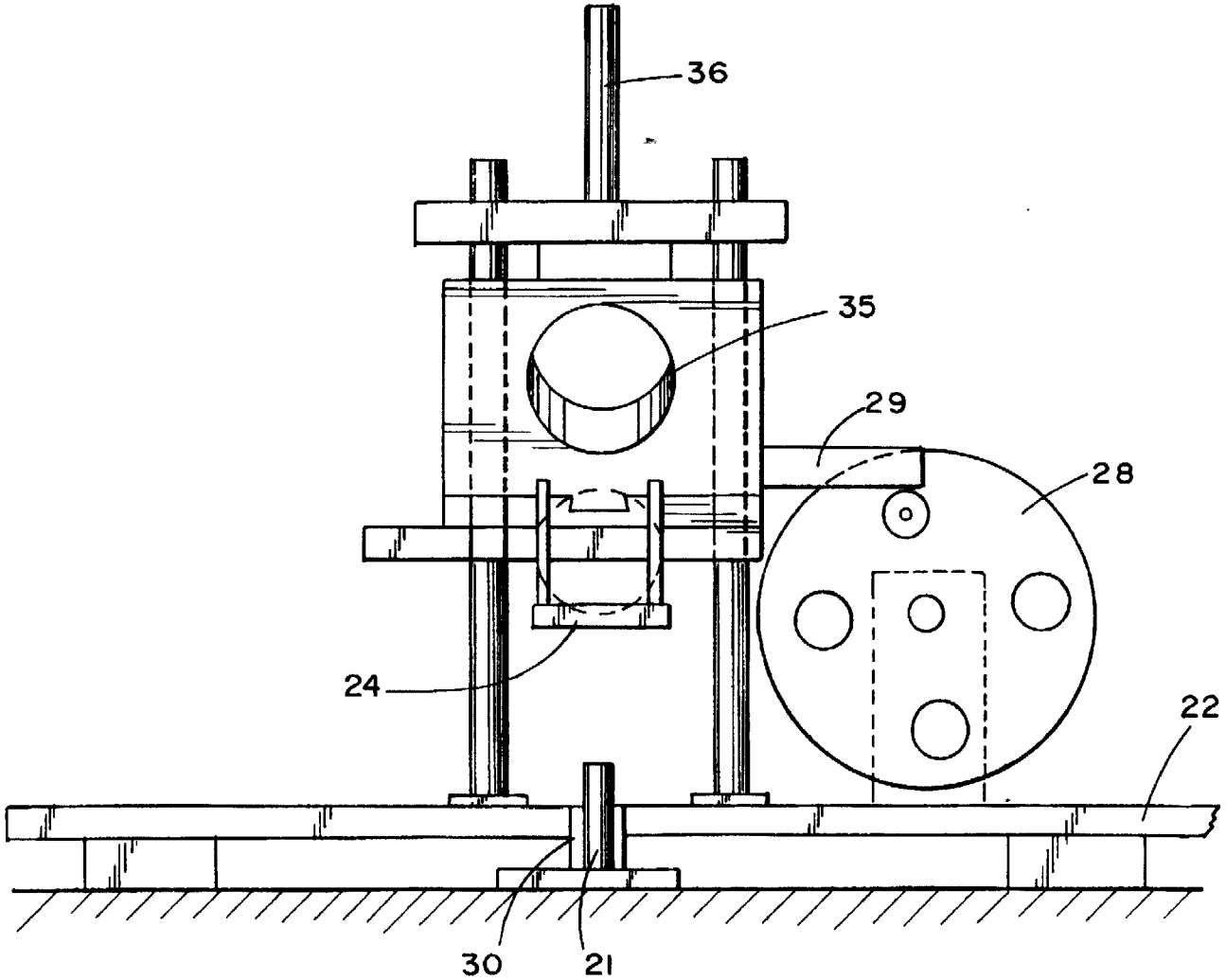

Golf balls are delivered from the storage container 20 into the storage chute 23. The balls cannot roll from the storage chute 23 because the barrier 36 is in place. When the controller 27 is activated, the motor 26 is activated to rotate the flywheel 28 in a clockwise direction as viewed in FIG. 1. When the flywheel 28 rotates, it moves the arm support 25 in the vertical direction until the microswitch 40 detects the support 25 reaching its upper position by changing to a closed state, thus transmitting a pulse to the pulse timer 41 to re-set it. This causes the motor 26 to be shut off at the position where the aperture 35 is in registry with the storage chute 23. As shown most clearly in FIGS. 6 and 7, while the main barrier 36 is out of the way, the auxiliary barrier 37 prevents the second and all subsequent balls from rolling in the storage chute 23. The first ball which was in the storage chute 23 then rolls down the arm 24 as shown in FIGS. 6 until it reaches the curved seat provided at the end of the arm 24. The ball is then positioned directly above the tee 21. When the motor shuts off, the flywheel 28 rotates in the anti-clockwise direction in a manner which provides a braking force for the arm 24 to prevent it falling under gravity. This damping is caused by a diode on the contacts of the motor 25 which acts as a current limiter. The slow downward movement of the arm 24 allows the ball 53 to reach the end of the arm 24 and also allows the ball to be placed securely on the tee 21 as the arm 24 moves downwardly.

The golfer then strikes the ball 53 from the tee 21, thus causing the tee 21 to vibrate to some extent. This vibration is detected by the vibration sensor 30. Pulses transmitted from the vibration sensor 30 are timed by the timer 41 which outputs a signal on the pin P6 if sufficient vibrations are detected. This signal turns on the transistor 43 which in turn pulls the relay 44, thus allowing a 12 Volt DC supply no be applied to the motor contacts 45. This activates the motor to rotate the flywheel 28 in a clockwise direction to repeat the cycle. Thus, by the time the golfer has taken his stance for the next shot a ball is in place on the tee without any input from the golfer being required.

Another significant advantage of the invention is that a conventional driving range tee is used. It will be appreciated that vertical movement of the arm 24 between upper and lower positions is extremely simple and the dispenser would thus be very reliable in use. It will also be appreciated that the arrangement provided for allowing discharge of balls onto the arm 24 is extremely simple as both the main and auxiliary barriers are mounted on the support 25 for the arm 24, all parts thus moving together. This allows use of only a single actuator, in this embodiment the motor 26. These features of the invention are extremely important as the major requirements of an automatic teeing device are low cost and reliability. Indeed, the inventors believe that complexity and apparent lack of reliability of the prior art devices explain why they have not gained widespread use.

It will also be appreciated that use of a detector to detect striking of a golf ball avoids the need for the golfer to have to actuate the mechanism each time he or she wishes to strike a new ball. Because the tee is fixed in position, relatively simple ball detectors such as a vibration sensor (as in the embodiment described) or a radiation sensor of any suitable type may be used reliably. This feature also leads to low-cost production and also to improved reliability in operation.

The invention is not limited to the embodiments hereinbefore described. For example, it is envisaged that a different detector may be used for detecting when a ball has been struck. For example, the detector may comprise a radiation sensor such as an ultrasonic, optical, or indeed an electromagnetic sensor. Because the detector need only detect ball presence on a fixed tee, a wide range of simple and inexpensive detectors may be used reliably. However, a vibration sensor is particularly advantageous because it is very unlikely to transmit a false signal and because its associated circuitry is inexpensive and reliable.

In another embodiment, it is envisaged that the arm may not move to a position below the level of the mat after placement. It may, for example, have an opening at the end of the arm to allow it to move sidewardly out of the way. It is also envisaged that a different actuator may be used for moving the arm, such as a pneumatic or an hydraulic system. It is also possible than the arm may hold more than one ball at a time and may indeed act as a chute in which each successive ball moves into position after the first ball has been placed on the tee.

What is claimed is:

1. A golf ball dispenser in combination with a tee for a driving range comprising:

a ball storage container;

a placement means for reception of a ball from the storage container and bringing a ball to rest position adjacent to an end of the placement means said placement means comprising an arm extending in a substantially horizontal direction and drive means for moving said arm in a substantially vertical direction in a linear motion to place a ball on the tee during a downward movement; and a controller comprising means for directing relative movement of the placement means to the tee allowing a ball to be placed on the tee and separating the placement means and a ball to expose a ball for use.

2. A dispenser as claimed in claim 1 further comprising a detector connected to the controller for detecting striking of a ball from the tee, and the controller further comprises a means for automatically directing placement of a fresh ball on the tee after a ball has been struck off the tee as sensed by the detector.

3. A dispenser as claimed in claim 2, wherein the detector is a vibration sensor mounted to detect vibration of the tee.

4. A dispenser as claimed in claim 3, wherein the detector is mounted on a support plate for the tee.

5. A dispenser as claimed in claim 3 wherein the controller comprises a pulse timer connected to the vibration sensor.

6. A dispenser as claimed in claim 1, wherein the controller comprises means for directing movement of the arm to a lower inoperative position beneath a level of a golf mat after placement of a ball, whereby a ball placement cycle involves an upward arm movement, receiving a ball from the ball storage container, followed by said downward movement to place the ball on the tee and to reach the inoperative position.

7. A dispenser as claimed in claim 1, wherein the drive means includes a motor.

8. A dispenser as claimed in claim 7, wherein the motor comprises a current limiter component for damping downward movement of the arm.

9. A dispenser as claimed in preceding claim 1 wherein the storage container comprises a storage chute, the arm being movable into registry with the chute for reception of the ball under control of a main barrier.

10. A dispenser as claimed in claim 9 wherein the main barrier is mounted on the arm and moves with it.

11. A dispenser as claimed in claim 9, further comprising an auxiliary barrier mounted to prevent delivery of more than one ball at one time to the arm from the storage chute.

12. A dispenser as claimed in claim 11 wherein the auxiliary barrier is mounted on the arm and moves with it.

* * * * *